US009475629B2

(12) United States Patent
Olsen

(10) Patent No.: US 9,475,629 B2
(45) **Date of Patent: *Oct. 25, 2016**

(54) CONTAINER CARRIER

(71) Applicant: Robert C. Olsen, Medinah, IL (US)

(72) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/223,558

(22) Filed: Mar. 24, 2014

(65) Prior Publication Data

US 2014/0202893 A1 Jul. 24, 2014

Related U.S. Application Data

(63) Continuation of application No. 11/512,677, filed on Aug. 30, 2006, now abandoned, which is a continuation-in-part of application No. 11/073,829, filed on Mar. 7, 2005, now Pat. No. 7,510,075.

(51) Int. Cl.
*B65D 71/50* (2006.01)

(52) U.S. Cl.
CPC ..... *B65D 71/504* (2013.01); *B65D 2203/02* (2013.01)

(58) Field of Classification Search
CPC .. B65D 71/504; B65D 71/50; B65D 71/506; B65D 2571/0066
USPC ..... 206/150, 427, 162, 163, 147, 141, 175, 206/151
See application file for complete search history.

(56) References Cited

U.S. PATENT DOCUMENTS

| | | | |
|---|---|---|---|
| 4,064,989 | A | 12/1977 | Olsen |
| 4,624,363 | A | 11/1986 | Edwards |
| 4,782,955 | A | 11/1988 | Weaver et al. |
| 5,305,877 | A | 4/1994 | Olsen |
| 5,487,465 | A | 1/1996 | Broskow |
| 5,593,026 | A | 1/1997 | Broskow |
| 5,642,808 | A | 7/1997 | Marco et al. |
| 5,653,334 | A | 8/1997 | Marco |
| 5,655,654 | A | 8/1997 | Broskow |
| 5,746,310 | A | 5/1998 | Slomski |
| 5,788,301 | A | 8/1998 | Slomski |
| 5,806,667 | A | 9/1998 | Marco |
| 6,068,125 | A | 5/2000 | Slaters, Jr. et al. |
| 6,148,994 | A | 11/2000 | Olsen |
| 6,152,508 | A | 11/2000 | Slomski |
| 6,170,652 | B1 | 1/2001 | Olsen |

(Continued)

FOREIGN PATENT DOCUMENTS

| | | |
|---|---|---|
| EP | 0 456 361 A2 | 11/1991 |
| EP | 0 842 865 A1 | 5/1998 |

(Continued)

OTHER PUBLICATIONS

Carrier Design, Mar. 10, 1992.

*Primary Examiner* — Steven A. Reynolds
(74) *Attorney, Agent, or Firm* — Pauley Erickson & Kottis

(57) ABSTRACT

A flexible carrier for carrying a plurality of containers includes a flexible sheet having a row of container-receiving apertures formed therein. The flexible carrier further includes a handle integrated with respect to the flexible sheet. A package is formed by inserting a plurality of containers, each within a respective container-receiving aperture.

20 Claims, 5 Drawing Sheets

(56) References Cited

U.S. PATENT DOCUMENTS

| | | | |
|---|---|---|---|
| 6,182,821 | B1 | 2/2001 | Olsen |
| 6,230,880 | B1 | 5/2001 | Marco et al. |
| 6,234,945 | B1 | 5/2001 | Weaver |
| 6,598,738 | B2 | 7/2003 | Weaver |
| 6,779,655 | B2 | 8/2004 | Olsen et al. |
| 7,510,075 | B2 | 3/2009 | Olsen et al. |
| 2003/0080004 | A1 | 5/2003 | Olsen et al. |
| 2004/0004365 | A1 | 1/2004 | Olsen |
| 2006/0118432 | A1 | 6/2006 | Weaver et al. |
| 2006/0196782 | A1 | 9/2006 | Olsen et al. |
| 2006/0289315 | A1 | 12/2006 | Olsen |

FOREIGN PATENT DOCUMENTS

| | | |
|---|---|---|
| EP | 1 077 185 A2 | 2/2001 |
| EP | 1 308 398 A2 | 5/2003 |

CONTAINER CARRIER

CROSS REFERENCE TO RELATED APPLICATION

This application is a continuation of U.S. patent application Ser. No. 11/512,677, filed 30 Aug. 2006, which is a continuation-in-part of U.S. patent application Ser. No. 11/073,829, filed 7 Mar. 2005, and issued as U.S. Pat. No. 7,510,075 on 31 Mar. 2009. The co-pending parent application is hereby incorporated by reference herein in its entirety and is made a part hereof, including but not limited to those portions which specifically appear hereinafter.

BACKGROUND OF THE INVENTION

1. Field of the Invention

This invention relates to a flexible carrier for carrying a plurality of containers such as bottles or cans.

2. Description of Prior Art

Conventional container carriers are often used to unitize a plurality of similarly sized containers, such as cans, bottles, jars and boxes and/or similar containers that require unitization. Plastic ring carriers and box carriers are two such conventional container carriers.

The plastic ring carrier produces a unitized package for containers using little material. However, in its traditional form, the plastic ring carrier has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and provides useful promotional area.

Flexible ring carriers are applied to containers by stretching the carrier around the perimeter of the container, and allowing the stretched carrier to recover, providing a tight fit. The carrier is typically applied to the chime or rib, where this structure exists, or to the main sidewall.

Application of traditional flexible ring carriers may result in inversions or local irregularities in portions of the carrier. In particular, the complex and variable geometries of carriers, containers, and application parameters sometimes yield undesirable, inconsistent or unpredictable local characteristics in the applied carrier, such as kinking, inverting, or cantilevering along the perimeter of the carrier or even around the containers. Such conditions may result in a loose and/or "floppy" package that lacks tight unitization of the containers or a non-smooth or inverted perimeter that is less aesthetic and the disposition of additional carrier features may be negatively affected as well.

SUMMARY OF THE INVENTION

The present invention is directed to a flexible carrier for containers that includes an upright handle and an arrangement of container receiving apertures that create a tight, unitized package of containers. The flexible carrier may further include one or more display panels.

According to preferred embodiments of this invention, each flexible carrier preferably includes two layers of flexible sheet each defining a row of container receiving apertures, each for receiving a container. Specifically, two layers of flexible sheet are preferably connected along a longitudinally extending centerline, such as a weld.

The container receiving apertures are preferably formed in a geometry that results in a tight unitization of containers, particularly in a two-wide direction of the resultant package. Specifically, each container receiving aperture is preferably tapered along an inner edge toward the weld of the flexible carrier. Each container receiving aperture may comprise at least five generally straight segments that together form a generally polygonal shape that includes a tapered inner, or handle side, edge.

A handle is preferably connected along a weld side of the row of container receiving apertures. A plurality of struts may connect the handle with a side of the row of container receiving apertures, preferably between the weld and the handle.

In addition, a panel is preferably formed along a side of the row of container receiving apertures opposite the handle. The panel preferably accommodates graphics, promotional and/or other information related to the containers and the package. According to one embodiment of the invention, a second panel may extend from the opposite side of the carrier resulting in two panels, each extending from opposite sides of row of container receiving apertures. As such, two contiguous panels may be formed in the two layers of flexible sheet.

The resulting package includes two layers of flexible sheet joined with the longitudinally extending weld and with row of container receiving apertures formed in each layer. One row of container receiving apertures is formed on each side of the weld resulting in the flexible carrier fanning out at the weld to permit a generally flat plane of engagement within which the containers are inserted. The handle then extends upwardly from the weld and between each row of container receiving apertures. One or more panels accordingly extend downwardly from at least one row of container receiving apertures so that each panel extends generally flush with the respective row of containers.

According to one alternative embodiment of the invention, a plurality of container receiving apertures are formed in two rows through a flexible sheet. A handle is positioned along one edge of the flexible sheet. The container receiving apertures are likewise elongated in a longitudinal direction of the carrier and preferably taper toward a center axis of the carrier.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
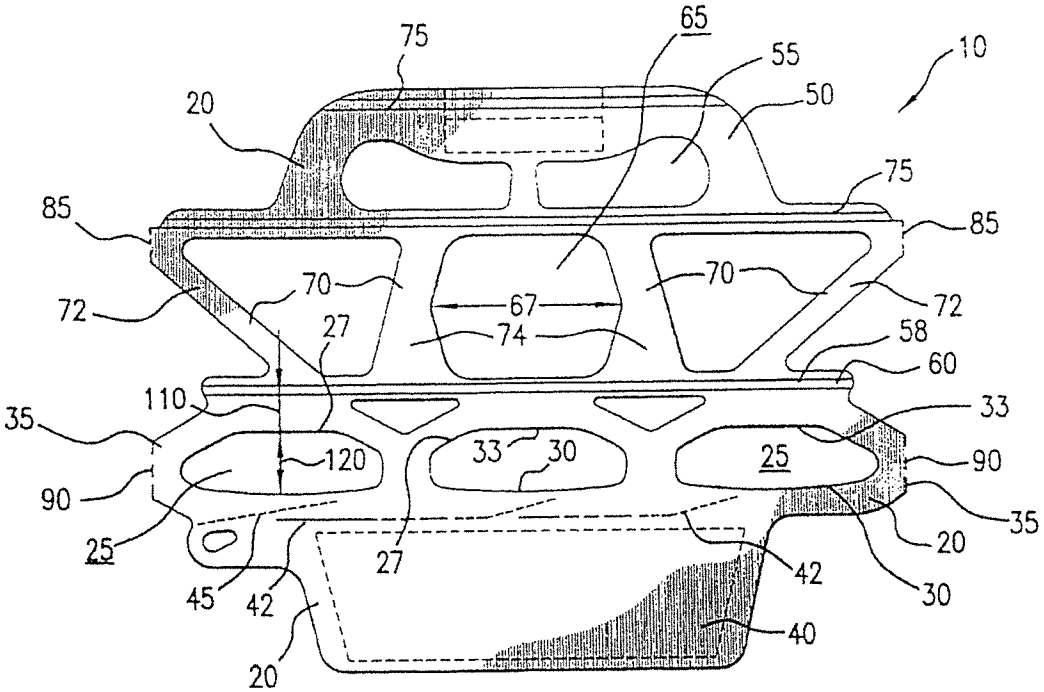
FIG. 1 is a side elevational view of a flexible carrier according to one preferred embodiment of this invention.
Figure 2:
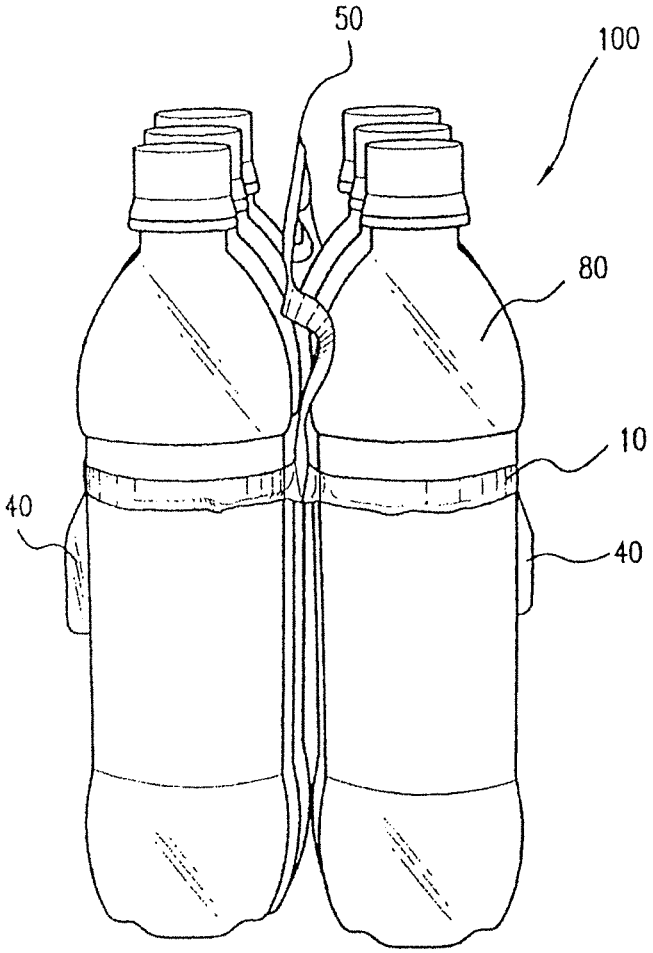
FIG. 2 is a front view of a package of containers according to one preferred embodiment of this invention.
Figure 3:
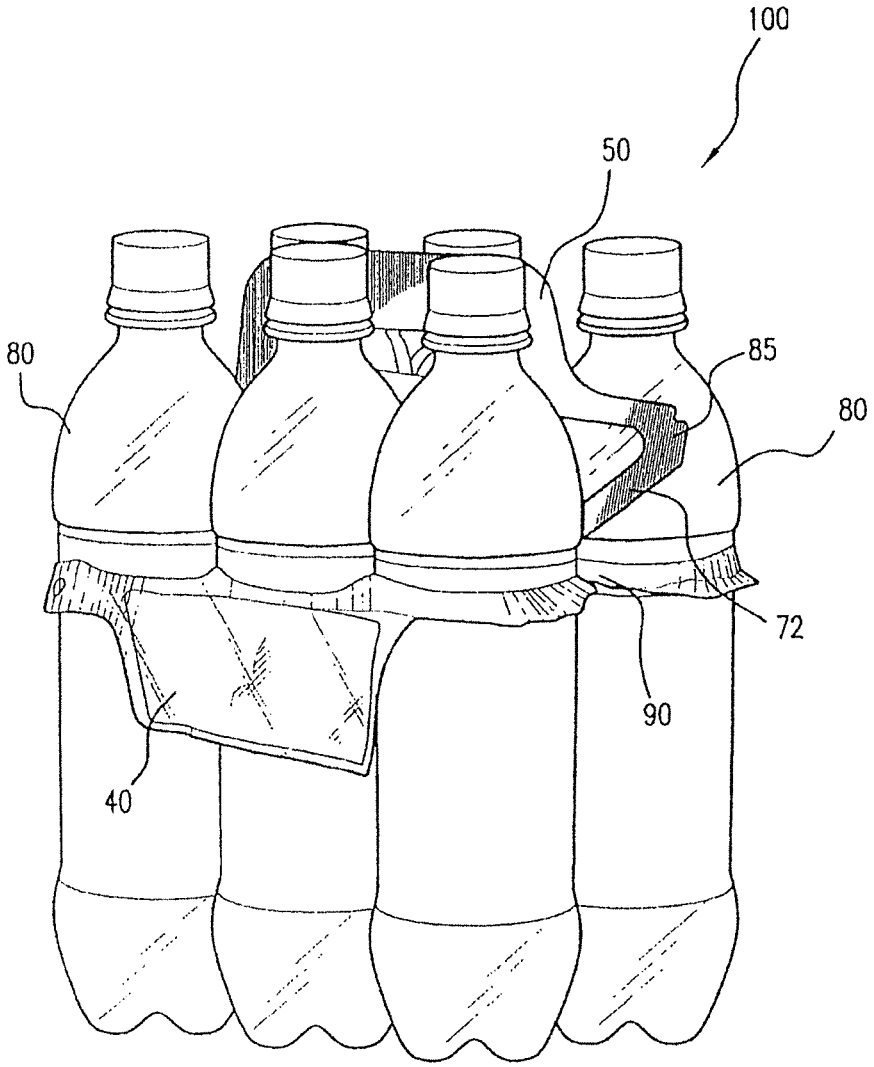
FIG. 3 is a front left perspective view of a package of containers according to one preferred embodiment of this invention.

FIG. 1 shows flexible carrier 10 for unitizing six containers to form a unitized package. FIGS. 2 and 3 show a package of unitized containers. Although FIGS. 1-3 illustrate various structures for flexible carrier 10 of the invention, the illustrations are exemplary, and the invention is not limited to the flexible carriers 10 or packages shown. For example, flexible carrier 10 may be configured and used to unitize four, eight, twelve or any other desired number of containers.

The containers, such as those shown in packages in FIGS. 2 and 3, are preferably bottles. Although bottles are shown in FIGS. 2 and 3, cans or any other commonly unitized container may be used with flexible carrier 10 according to this invention. The containers are preferably, though not necessarily, like-sized within a single flexible carrier 10.

Each flexible carrier 10 preferably includes flexible sheet 20 defining a plurality of container receiving apertures 25, each for receiving container 80. Specifically, two layers of flexible sheet 20 are connected along a longitudinally extending centerline 58. Centerline 58 as used herein generally describes a segment between rows of container receiving apertures 25 and/or between layers of flexible sheet 20. According to one preferred embodiment of this invention, centerline 58 comprises weld 60 that joins the two layers of flexible sheet 20. The two layers of flexible sheet 20 may be coextruded, welded, or otherwise joined together to create flexible carrier 10. "Weld" as used in the specification and claims may be defined as a hot weld, cold weld, lamination or any other manner of connection that joins two sheets of material known to those having ordinary skill in the art.

As shown in FIG. 1, a row of container receiving apertures 25 is preferably formed in each layer of the two layers of flexible sheet 20. As such, one row of container receiving apertures 25 is preferably formed along each side of the centerline, such as weld 60. Container receiving apertures 25 are preferably formed in a geometry that results in a tight unitization of containers 80 without excess play and/or sliding between and among containers 80 and flexible carrier 10.

According to one preferred embodiment of this invention, a centerline distance 110 between centerline 58 and an inner, tapered edge of container receiving aperture 25 is approximately half of a width 120 of container receiving aperture. Other suitable geometries may be provided that result in tight unitization of containers 80, particularly in the two wide, or transverse direction of package 100.

Container receiving apertures 25 are preferably elongated in a longitudinal direction of flexible carrier 10. Specifically, according to one preferred embodiment of this invention, each container receiving aperture 25 include a length that extends longitudinally across flexible carrier 10 that is between 2 and 4 times greater than a corresponding width. More specifically, each container receiving aperture 25 is preferably between approximately 2.5 and approximately 3.5 times longer than wide. For example, flexible carrier 10 shown in FIG. 1 includes container receiving apertures 25 in outer positions that each have a length approximately 3.0 times greater than a corresponding width and a container receiving aperture 25 in a center position that has a length approximately 2.8 times greater than a corresponding width.

Figure 4:
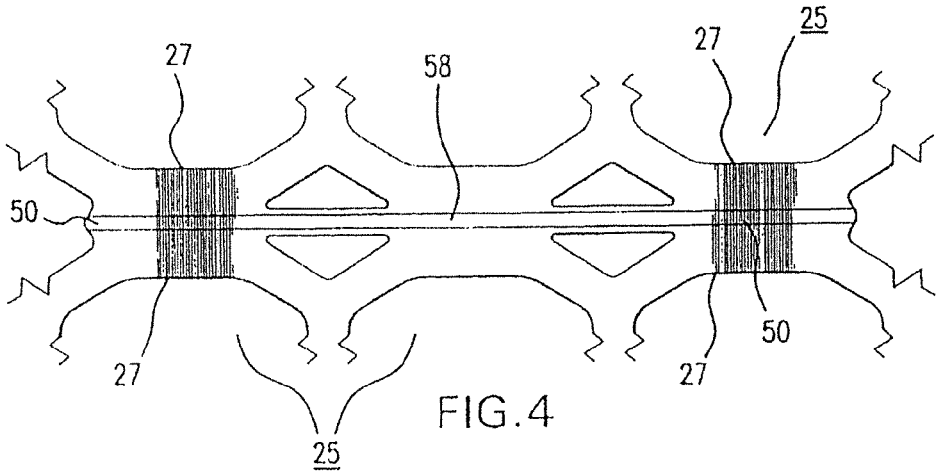
FIG. 4 is a top schematic view of a portion of a flexible carrier according to one preferred embodiment of this invention.

As best shown in FIGS. 1 and 4, according to one preferred embodiment of this invention, each container receiving aperture 25 includes tapered portion 27 that is tapered along an inner edge 33 toward a handle side of the row of flexible carrier 10, more specifically, each container receiving aperture 25 includes tapered portion 27 that is tapered toward weld 60. As used herein, "tapered" is defined as a container receiving aperture 25 becoming smaller toward one side, i.e., each container receiving aperture 25 is gradually diminished in width toward one side of the respective container receiving aperture 25.

Accordingly, each container receiving aperture 25 preferably comprises at least five generally straight segments that together form a generally polygonal shape that includes a tapered inner, or handle side, edge. As shown in FIG. 4, the tapered edge preferably comprises three generally straight segments that together form a plateau on the handle side of the flexible carrier 10. As shown in FIG. 1, an inner container receiving aperture 25 of the row includes six generally straight segments that together form a configuration having a taper or smaller side along the handle side of flexible carrier 10. Each outer container receiving aperture 25 of the row preferably includes five generally straight segments that together likewise form a configuration having a taper or smaller side along the handle side of flexible carrier 10. As defined herein, "straight segments" are respective segments of the perimeter of each container receiving aperture 25 each separated by a transition radius. Although such straight segments may include a slight radius, such transition radii each have a considerably smaller radius of curvature than the slight radii of such straight segments.

As a result of the described geometry, flexible carrier 10 may be applied to containers without interference from panel 40. Specifically, as a result of such geometry, the distance from outer edges 35 of each row of container receiving apertures 25 is substantial enough, and increased over the existing art, to permit engagement with machine jaws that apply flexible carrier 10 to containers 80.

In addition, problems of prior art carriers such as inversion of portions of the carrier relative to the containers are significantly reduced or eliminated by the geometry as described. As result of the configuration of the subject invention, flexible carrier 10 results in a tight and consistent package 100 without any movement of flexible carrier 10 relative to containers 80, particularly in areas surrounding container receiving apertures 25. As such, flexible carrier 10 will not move upward, downward or laterally relative to the unitized containers 80 and will thus maintain a solid package 100. In addition, the described geometry results in a vertically aligned panel 40 relative to package 100, as described in more detail below.

According to a preferred embodiment of this invention, a pitch of flexible carrier 10, i.e., a distance between center points of adjacent container receiving apertures 25 in each row, is constant across a longitudinal distance of flexible carrier 10. As such, a distance between a center of each outer container receiving aperture 25 to a center of the center container receiving aperture 25 is preferably identical.

As shown in FIG. 4, according to one preferred embodiment of this invention, handle 50 is formed along the centerline 58 between the two rows of container receiving apertures 25 and in a separate plane from the two rows of container receiving apertures 25. Specifically, as shown in FIG. 1, handle 50 is connected along a side of the row of container receiving apertures 25, and is preferably connected with respect to centerline 58, such as weld 60.

Handle 50 is preferably positioned along an outer periphery, or on an outboard side of flexible carrier 10. Handle 50 may additionally comprise one or more elongated apertures 55 positioned along the outer periphery of handle 50 or similar configuration that provides an ample area for a purchaser to grab by inserting his hand through and still maintain the purpose and integrity of package 100.

As best shown in FIG. 1, a plurality of struts 70 connect handle 50 with a side of the row of container receiving apertures 25, preferably between weld 60 and handle 50. As struts 70 are preferably formed in both layers of flexible sheet 20, one or more handle welds 75 may be positioned longitudinally across handle 50. The plurality of struts 70 may comprise inner struts 74 located across internal portions of container carrier 10 and outer struts 72 located across a periphery of container carrier 10.

Figure 5:
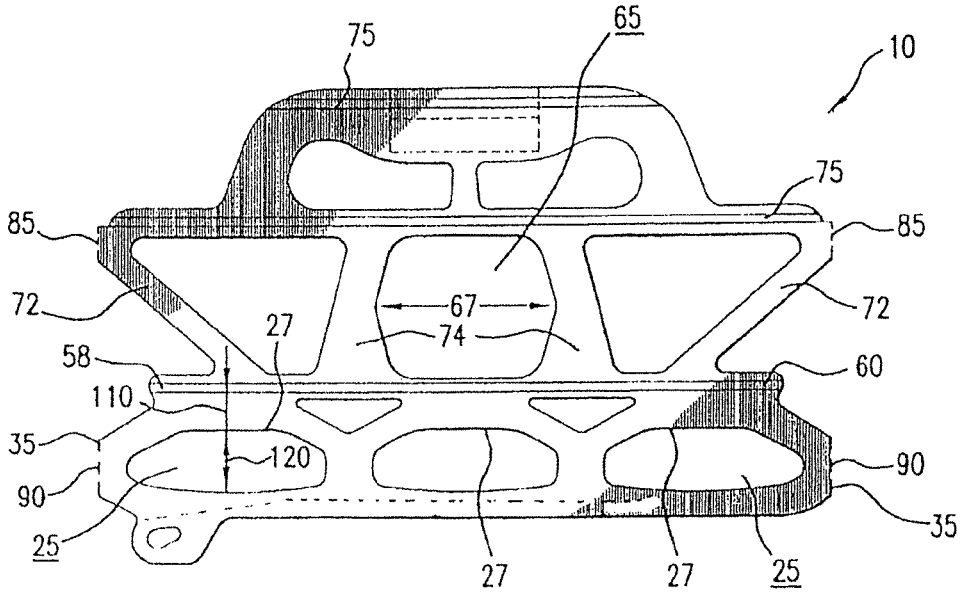
FIG. 5 is a side elevational view of a flexible carrier according to one preferred embodiment of this invention.

According to one preferred embodiment of this invention, each inner strut 74 preferably includes a non-uniform width as such inner strut 74 extends between the rows of container receiving openings 25 and handle 50. As shown in FIGS. 1 and 5 such inner struts 74 may be generally wider than outer struts 72.

According to one preferred embodiment of this invention, each outer strut 72 of the plurality of struts 70 extend longitudinally outward a distance approximately equal to each outer longitudinal edge 35 of the row of container receiving apertures 25. Flexible carriers 10, such as disclosed herein, are generally wound onto spools or reels or into boxes in a generally continuous end-to-end relationship. Without compensation, winding flexible carrier 10 having peripheral features such as handle 50 and panel 40 may result in tangling and knotting between and among adjacent flexible carriers 10 within the reel or box. As such, the present invention preferably includes at least two connection points between each adjacent flexible carrier 10 in the continuous string of flexible carriers 10. Such connection points maintain flexible carrier 10 in a flat, orderly position during the winding process.

As shown in FIG. 1, first connection point 85 is preferably located between outer struts 72 in adjacent flexible carriers 10. Second connection point 90 is preferably located between outer longitudinal edges 35 of the row of container receiving apertures 25 in adjacent flexible carriers 10. Because the row of container receiving apertures 25 may be formed in two contiguous layers of flexible sheet 20, second connection point 90 may actually comprise two overlapping connection points. By positioning outer struts 72 in a longitudinally outward manner, first and second connection points 85, 90 are generally aligned to permit smooth winding of generally continuous strings of flexible carriers 10.

According to one preferred embodiment of this invention as briefly described above, a generally continuous string of container carriers 10 may be placed into boxes for shipment and storage and subsequent application to groups of containers 80. A fan folding process may be employed wherein such strings of container carriers 10 are fan folded, like pin-feed computer paper, into a plurality of stacks of container carriers. Slaters, Jr., U.S. Pat. No. 6,068,125 issuing on 30 May 2000 and titled METHOD AND APPARATUS FOR STORING AND DISPENSING CONTAINER CARRIERS teaches one such method and is hereby incorporated by reference. Such fan folded stacks of container carriers may be placed onto dividers or rods so as to properly index the respective fan folded stacks.

According to one preferred embodiment of this invention, flexible carrier 10 may further include index aperture 65 located in an area between handle 50 and the rows of container receiving apertures 25. Index aperture 65 such as shown in FIGS. 1 and 5 may comprise a hexagon having a span 67 of at least approximately 1.5" and more preferably at least approximately 2.0". Such size of index aperture 65 permits fan folding of flexible carrier 10 in a manner consistent with the incorporated reference.

As best shown in FIGS. 1 and 3, panel 40 is preferably formed along a side of the row of container receiving apertures 25 opposite handle 50. Panel 40 preferably accommodates, on one or both sides, UPC and proof of purchase labels, graphics, and promotional and/or other information related to contents and/or ingredients of containers 80 and/or package 100.

Panel 40 may be separated from the row of container receiving apertures 25 with one or more panel slits 42. Panel slits 42 preferably follow the natural path of tear strip 45, discussed in more detail below, to assist in removal of containers 80 and/or panel 40 from flexible carrier 10.

According to one alternative embodiment of this invention, panel 40 may extend from each side of carrier 10 resulting in two panels 40, each extending from opposite sides of longitudinal row 25. FIG. 2 shows panels 40 positioned on each side of package 100. This configuration permits a panel 40 to face outward from a shelf regardless of how carrier 10 is placed on the shelf. In this arrangement of flexible carrier 10 wherein an additional panel 40 is formed along the side of the row of container receiving apertures 40, two contiguous panels 40 are formed in the two layers of flexible sheet 20.

Panel 40 may be generally continuous and unbroken, without cutouts or apertures, throughout its defined area, as shown in FIGS. 1 and 3. Alternatively, panel 40 may include one or more cutouts for weight reduction and material savings. An adhesive label may be applied to panel 40 to bring color, graphics and/or other information to panel 40.

As shown in FIGS. 1 and 3, panel 40 is preferably tapered along its transverse panel edges. Preferably, panel 40 extends in a transverse direction for a panel height at least as high as a width of container receiving aperture 25. More preferably, the panel height is at least as long as a distance from weld 60 to an outer edge 30 of the row of container receiving apertures 25. However, the panel height of panel 40 is preferably less than a height of container 80.

According to one preferred embodiment of this invention, tear strip 45 extends between panel 40 and the row of container receiving apertures 25. Accordingly, panel 40 and/or the container receiving apertures 25 are preferably separable along tear strip 45.

As shown in FIGS. 2 and 3, package 100 resulting from flexible carrier 10 includes a plurality of unitized containers 80. As a result of the described configuration, two layers of flexible sheet 20 joined with the longitudinally extending weld 60 include a row of container receiving apertures 25 formed in each layer of the two layers of flexible sheet 20. One row of container receiving apertures 25 is formed on each side of weld 60 resulting in flexible carrier 10 fanning out at weld 60 to permit a generally flat plane of engagement within which containers 80 are inserted. Each row of container receiving apertures 25 thereby engages a respective row of containers 80.

Handle 50 then extends upwardly from weld 60 and between each row of container receiving apertures 25. Struts 70 permit proper separation between weld 60 and handle 50 to permit a comfortable grasping area within package 100. As shown in FIG. 3, each outer strut 72 of the plurality of struts 70 extends longitudinally outward a distance beyond each outer longitudinal edge 35 of package 100.

One or more panels 40 accordingly extend downwardly from at least one row of container receiving apertures 25 so that each panel 40 extends generally flush with the respective row of containers 80.

Figure 6:
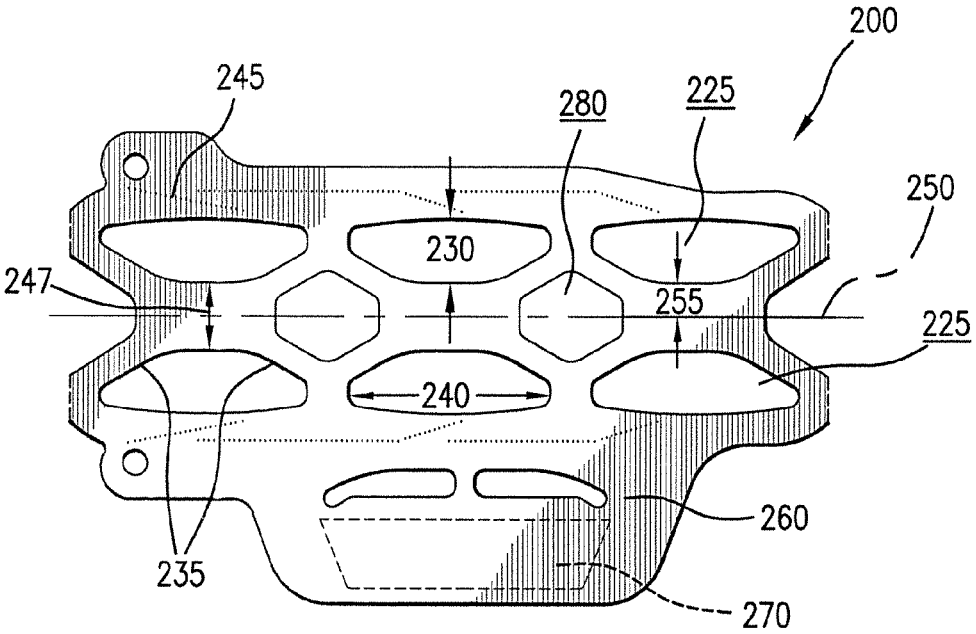
FIG. 6 is a side elevational view of a flexible carrier according to one preferred embodiment of this invention.
Figure 7:
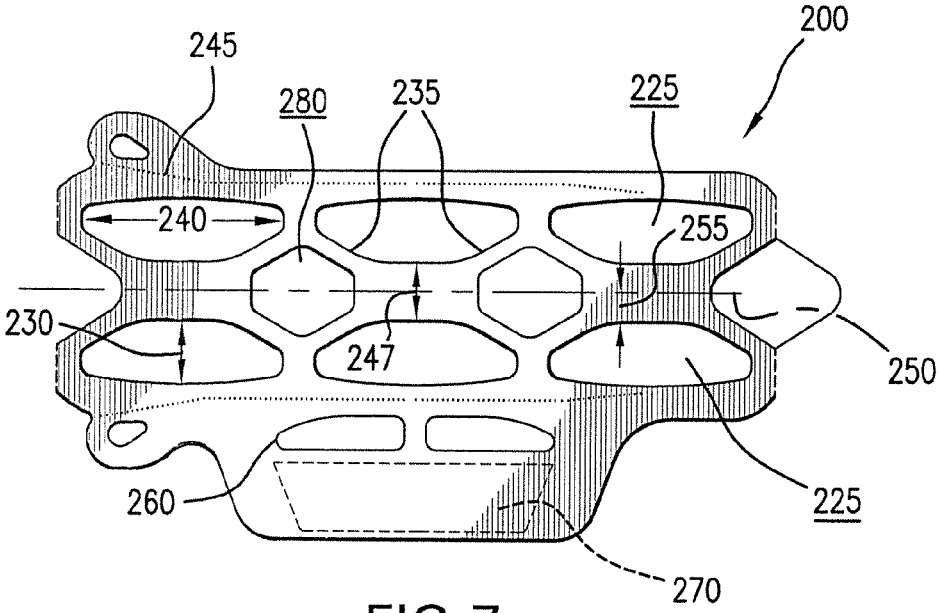
FIG. 7 is a side elevational view of a flexible carrier according to one preferred embodiment of this invention.

According to another preferred embodiment of this invention shown in FIGS. 6 and 7, carrier 200 includes flexible sheet having a plurality of container receiving apertures 225 arranged in two rows.

Container receiving apertures 225 are preferably elongated in a longitudinal direction of flexible carrier 200. Specifically, according to one preferred embodiment of this invention, each container receiving aperture 225 includes length 240 that extends longitudinally across flexible carrier 200 that is between 2 and 4 times greater than corresponding width 230. More specifically, each container receiving aperture 225 is preferably between approximately 2.5 and approximately 3.5 times longer than wide. For example, flexible carrier 200 shown in FIG. 6 includes container receiving apertures 225 in outer positions that each have length 240 approximately 3.1 times greater than corresponding width 230. Likewise, container receiving aperture 225 in a center position has length 240 approximately 3.1 times greater than corresponding width 230.

According to one preferred embodiment of this invention, width 230 of each container receiving aperture 225 is preferably approximately equal to a spacing 247 between adjacent transverse pairs of container receiving apertures 225. In addition, a center distance 255 between a center axis 250 and an inner, tapered edge of container receiving aperture 225 is approximately half of width 230 of container receiving aperture. As shown in FIG. 6, center distance 255 is defined by a distance from center axis 250 between the two rows of container receiving apertures 225 and an inner, tapered edge of container receiving aperture 225.

Preferably, outer pairs of container receiving apertures 225 are longer than inner pairs of container receiving apertures 225. Other suitable geometries may be provided that result in tight unitization of containers 80, particularly in the two wide, or transverse direction of the package.

As best shown in FIGS. 6 and 7, according to one preferred embodiment of this invention, each container receiving aperture 225 includes tapered portion 235 that is tapered toward a center axis 250 between rows. Carrier 200 may further include a row of index apertures 280 positioned between the two rows of container receiving apertures 225, each index aperture 280 having a generally hexagonal shape. Preferably, the generally hexagonal shape of the index aperture 280 generally follows the taper of container receiving apertures 225.

According to a preferred embodiment of this invention, handle 260 is formed adjacent to and along one row of container receiving apertures 225. In addition, tear strip 245 may be formed between handle 260 and the plurality of container receiving apertures 225.

According to one embodiment of this invention, panel 270 may extend from a side of carrier 200, specifically, panel 270 may be integrated with handle 260. As shown in FIGS. 6 and 7, panel 270 is preferably tapered along its transverse panel edges.

While in the foregoing specification this invention has been described in relation to certain preferred embodiments thereof, and many details have been set forth for purpose of illustration, it will be apparent to those skilled in the art that flexible carrier and the related method of manufacture are susceptible to additional embodiments and that certain of the details described herein can be varied considerably without departing from the basic principles of the invention.

I claim:

1. A flexible carrier for carrying a plurality of containers comprising:

a flexible sheet having two rows of container receiving apertures formed therein, each container-receiving aperture having a length that extends longitudinally along the flexible carrier and each container-receiving aperture in each row of container-receiving apertures including at least three generally straight segments forming a taper toward the other row of container-receiving apertures, each container receiving aperture tapering to a plateau and including one of the at least three generally straight segments, wherein the plateau is longer than two other straight segments of the at least three generally straight segments and longer than a longitudinal distance between adjacent container-receiving apertures and wherein the plateau is parallel to a center axis of the flexible sheet, and each container-receiving aperture elongated so that the length is between 2 and 4 times greater than a corresponding width, wherein a maximum width of each container-receiving aperture is approximately equal to a solid band of material longer than the plateau spaced between adjacent transverse pairs of container-receiving apertures; and a handle formed along one row of container-receiving apertures.

2. The flexible carrier of claim 1 further comprising a row of index apertures positioned between the two rows of container-receiving apertures, each index aperture having a generally hexagonal shape.

3. The flexible carrier of claim 1 wherein outer pairs of container-receiving apertures are longer than inner pairs of container-receiving apertures.

4. The flexible carrier of claim 1 further comprising a tear strip formed between the handle and the plurality of container-receiving apertures.

5. The flexible carrier of claim 1 wherein a center distance is defined by a distance from the center axis between the two rows of container-receiving apertures and an inner, tapered edge of container-receiving aperture, wherein the center distance is more than half of the width of each container-receiving aperture.

6. A package including a plurality of containers unitized within a flexible carrier, the package comprising:

a flexible sheet;

two rows of container-receiving apertures formed in the flexible sheet, each container-receiving aperture in each row including at least three generally straight segments forming a concave taper towards the other row and each container-receiving aperture elongated so that a length that extends longitudinally along the flexible carrier is between 2 and 4 times greater than a corresponding width and a plateau of the at least three generally straight segments is parallel to a center axis of the flexible carrier, wherein the plateau is longer than a longitudinal distance between adjacent container-receiving apertures, each row of container-receiving apertures engaging a respective row of containers, wherein a maximum width of each container-receiving aperture is approximately equal to a solid band of material longer than the plateau spaced between adjacent transverse pairs of container-receiving apertures;

a row of index apertures positioned between the two rows of container-receiving apertures, each index aperture having a shape having at least four sides, wherein four sides of the shape each extend generally parallel to a respective straight segment in an adjacent container receiving aperture; and a handle from along one row of container-receiving apertures.

7. The package of claim 6 wherein a center distance is defined by a distance from the center axis between the two rows of container-receiving apertures and an inner, tapered edge of container-receiving aperture, wherein the center distance is more than half of the width of each container-receiving aperture.

8. A carrier formed from a flexible sheet for carrying a plurality of containers, the carrier comprising:

two rows of container-receiving apertures formed in the flexible sheet, each container-receiving aperture in each row of container-receiving apertures including at least three generally straight segments forming a taper toward the other row of container-receiving apertures, wherein an apex of each container-receiving aperture includes one of the at least three generally straight segments, the apex is parallel to a center axis of the carrier and extends longer than a longitudinal distance between adjacent container-receiving apertures, and each container-receiving aperture elongated so that a length that extends longitudinally across flexible carrier is between 2 and 4 times greater than a corresponding width, wherein a maximum width of each container-receiving aperture is approximately equal to a spacing between the rows of container-receiving apertures, and wherein outer pairs of container-receiving apertures are longer than inner pairs of container-receiving apertures;

a row of index apertures positioned between the two rows of container-receiving apertures, each index aperture having a shape having at least four sides;

a handle formed along one row of container-receiving apertures; and a tear strip formed between the handle and the plurality of container-receiving apertures.

9. The carrier of claim 8 wherein four sides of the shape each extend generally parallel to a respective straight segment in an adjacent container receiving aperture.

10. The carrier of claim 8 wherein an outer edge of each container-receiving aperture is generally arcuate.

11. The carrier of claim 8 wherein the apex of each container-receiving aperture comprises a plateau, wherein the plateau is longer than a two other straight segments of the at least three generally straight segments.

12. The carrier of claim 11 wherein the plateau extends at least a quarter of the length of the container receiving aperture.

13. The carrier of claim 1 wherein an outer edge of each container-receiving aperture is generally arcuate.

14. The carrier of claim 1 wherein the plateau extends at least a quarter of the length of the container receiving aperture.

15. The carrier of claim 1 wherein at least two obtuse angles are formed in each index aperture.

16. The carrier of claim 1 wherein the flexible sheet between the plateaus of adjacent transverse pairs of container-receiving apertures is generally solid and uninterrupted.

17. The carrier of claim 6 wherein the flexible sheet between adjacent transverse pairs of container-receiving apertures is generally solid and uninterrupted.

18. The carrier of claim 6 wherein an apex of each container-receiving aperture comprises a plateau, wherein the plateau is longer than a two other straight segments of the at least three generally straight segments.

19. The carrier of claim 18 wherein the plateau extends at least a quarter of the length of the container receiving aperture.

20. The carrier of claim 6 wherein an outer edge of each container-receiving aperture is generally arcuate.

* * * * *